United States Patent [19]

Yogo et al.

[11] Patent Number: 4,608,208

[45] Date of Patent: Aug. 26, 1986

[54] CONTROL VALVE DEVICE

[75] Inventors: Kenji Yogo; Mamoru Nakamura, both of Toyota; Shigeru Nishio, Kariya, all of Japan

[73] Assignee: Aisin Seiki Kabushiki Kaisha, Kariya, Japan

[21] Appl. No.: 768,579

[22] Filed: Aug. 23, 1985

[30] Foreign Application Priority Data

Aug. 24, 1984 [JP] Japan ..... 59-177288

[51] Int. Cl.[4] ..... F02M 5/08

[52] U.S. Cl. ..... 261/39 R; 261/72 R; 261/DIG. 67; 251/337; 236/75; 236/101 C; 236/93 R

[58] Field of Search ..... 261/DIG. 67, 72 R, 39 R; 236/101 C, 101 D, 75, 93 R; 251/337

[56] References Cited

U.S. PATENT DOCUMENTS

| | | | |
|---|---|---|---|
| 2,609,989 | 9/1952 | Burklin | 236/75 |
| 3,168,242 | 2/1965 | Diener | 236/75 |
| 3,279,498 | 10/1966 | McKinley et al. | 236/75 |
| 3,548,797 | 12/1970 | Hagihara et al. | 261/DIG. 67 |
| 3,645,443 | 2/1972 | Willson et al. | 236/34 |
| 3,664,582 | 5/1972 | Jackson et al. | 236/93 R |
| 4,227,646 | 10/1980 | Hart et al. | 236/93 R |
| 4,284,235 | 8/1981 | Diermayer et al. | 236/1 G |
| 4,458,840 | 7/1984 | Hashimoto et al. | 236/101 C |
| 4,524,947 | 6/1985 | Barnes et al. | 251/337 |

FOREIGN PATENT DOCUMENTS

| | | | |
|---|---|---|---|
| 2758638 | 5/1979 | Fed. Rep. of Germany | 236/75 |
| 58-192953 | 10/1983 | Japan | 261/DIG. 67 |

*Primary Examiner*—Tim Miles

*Attorney, Agent, or Firm*—Oblon, Fisher, Spivak, McClelland & Maier

[57] ABSTRACT

A control valve device for use in a carburetor outer vent control system of an automotive internal combustion engine. The device includes a solenoid coil generating a magnetic force and a spring made of a shape memory alloy so that the device may control fluid communication in a fluid passage in response to an input current signal from a switch device and in response to changes in engine ambient temperature.

5 Claims, 2 Drawing Figures

CONTROL VALVE DEVICE

BACKGROUND OF THE INVENTION

1.Field of the Invention:

This invention relates to control valve devices in general, and more particularly to a control valve device which controls fluid communication in a fluid passage in response to both an input current signal from a switch device and in response to a signal indicating a change in engine ambient temperature.

2.Discussion of the Background:

Valve devices of the type to which the present invention is directed are particularly well adapted for use in a carburetor outer vent control system of an automotive internal combustion engine and which prevents fuel evaporative gas produced in a carburetor float chamber from being discharged into the atmosphere.

FIG. 2 shows a conventional example of the above-noted carburetor outer vent control system wherein when an engine ignition switch 51 is actuated to start the engine, an electric current is applied to a solenoid coil 53 from a battery 52 as an electric source. As a result, an electromagnetic valve 54 is maintained in a closed position thereby blocking a fuel evaporative gas passage 55. This electromagnetic valve 54 is a normally open type valve which is maintained in an opened state when the switch 51 is in an OFF position. Therefore, the fuel evaporative gases produced in a carburetor float chamber 56 cannot be absorbed on a canister 57 during the engine operation. In this case, the fuel evaporative gases are supplied to the engine through an inner vent tube 58 and an air-fuel induction passage 59 of a carburetor 62, and then are burned.

Next, when the engine is stopped, no electric current is applied to the solenoid coil 53 to thereby maintain the electromagnetic valve in an open position. At this time, the ambient engine temperature still being high, fuel in the float chamber 56 is evaporated. The evaporated fuel gas, namely the fuel evaporative gases, are absorbed in the canister 57 by means of the electromagnetic valve 54 positioned in the fuel evaporative gases passage 55 and by means of the thermal responsive control valve 60, thereby preventing the fuel evaporative gases from being discharged into the atmosphere. The control valve 60 is maintained opened at a high temperature (over approximately 50° C.), and closed at a low temperature, respectively.

As time proceeds after the engine is stopped, the engine temperature falls. When the temperature falls below a predetermined value, the control valve 60 is maintained closed, thereby preventing the fuel evaporative gases from being absorbed in the canister 57. However, since the fuel is only slightly evaporated due to the drop in the fuel temperature within the float chamber 56, such is not a serious problem even if the absorption of the canister is interrupted.

As shown in FIG. 2, the carburetor 62 is, of the downdraft type, having the air-fuel induction passage 59 at one end thereof and connected to an engine intake manifold 63 at the opposite end thereof. The induction passage 59 includes a throttle valve 61 which is rotatably maintained on a part of the carburetor body across the passage 59 in a manner so as to control the flow of the air-fuel mixture into the intake manifold 63.

In the conventional carburetor outer vent control system shown in FIG. 2, however, both the electromagnetic valve 54 operable in response to the ignition switch 51 and the thermal responsive control valve 60 operable in response to changes in the engine temperature are separately constructed. Therefore, the number of parts constituting the control system 50 will increase and the control system 50 thus becomes larger in size, whereby it may be difficult to install the control system 50 on the internal combustion engine. Furthermore, the thermal responsive control valve 60 operates in response to an ambient temperature in the vicinity of the carburetor 62. Since this ambient temperature is not exactly the same as the temperature in the carburetor float chamber 56, with the result that a certain difference in temperature may be observed, the outer vent control system 50 cannot operate with high accuracy in response to changes in temperature of the float chamber 56.

SUMMARY OF THE INVENTION

A principal object of the present invention therefore, is to provide a new and improved control valve device which is well adapted for use in a carburetor outer control system of an automotive internal combustion engine.

A further object of the present invention is to provide a control valve device wherein an electromagnetic valve and a thermal responsive valve are integrally connected and form a unitary valve body.

Another object of the present invention is to provide a control valve device wherein a spring made of a shape memory alloy is incorporated as a thermal responsive means, is comparatively simple in construction, and is thoroughly reliable in operation.

In one illustrative embodiment of the present invention, there is provided a control valve device which includes a body member having an inlet port and an outlet port, a fluid passage formed in the body member and connecting the inlet port and the outlet port, a valve member disposed in the fluid passage and controlling fluid communication in the fluid passage, a yoke made of a magnetic material and fixedly secured on the body member, an inner core disposed on a central axis in the yoke, a bobbin made of a nonmagnetic material and disposed on an outer periphery of the inner core, a solenoid coil wound on the bobbin and forming a magnetic circuit with the yoke and the inner core, a plunger member positioned in the magnetic circuit and attracted by an inner core upon energization of the solenoid coil, a shaft member fixed in the plunger member at one end thereof and operatively associated with the valve member at the other end thereof, a first spring supported by the body member at one end and biasing the valve member in a direction of a closed position thereof, and a second spring supported by the body member at one end and biasing the valve member in a direction of an open position thereof against the biasing force of the first spring. The second spring is made of a shape memopry alloy and is expanded to be of a predetermined memorized shape at a high temperature.

When no electric current is applied to the solenoid coil, the movement of the valve member depends on a force balance between the first spring and the second spring. When the temperature in the carburetor float chamber is kept low (i.e., falls below a predetermined value), the valve member will be maintained in the closed position by a biasing force of the first spring having a greater load than that of the second spring, thereby blocking the communication between the inlet port and the outlet port. When the temperature in the carburetor float chamber rises and is kept high, the second spring will be maintained in an expanded shape which is memorized beforehand, whereby the load of the second spring is greater than that of the first spring. As a result, the valve member will be maintained in the open position thereof, thereby establishing communication between the inlet port and the outlet port.

Upon energization of the solenoid coil, the plunger member is attracted by the inner core, whereby the shaft member fixed in the plunger member is moved in the direction for being engaged with the valve member. Consequently, the valve member is maintained in a closed position. Thus, during energization of the solenoid coil, the valve member can be maintained in the closed position in spite of the changes in temperature, thereby blocking the communication between the inlet port and outlet port.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
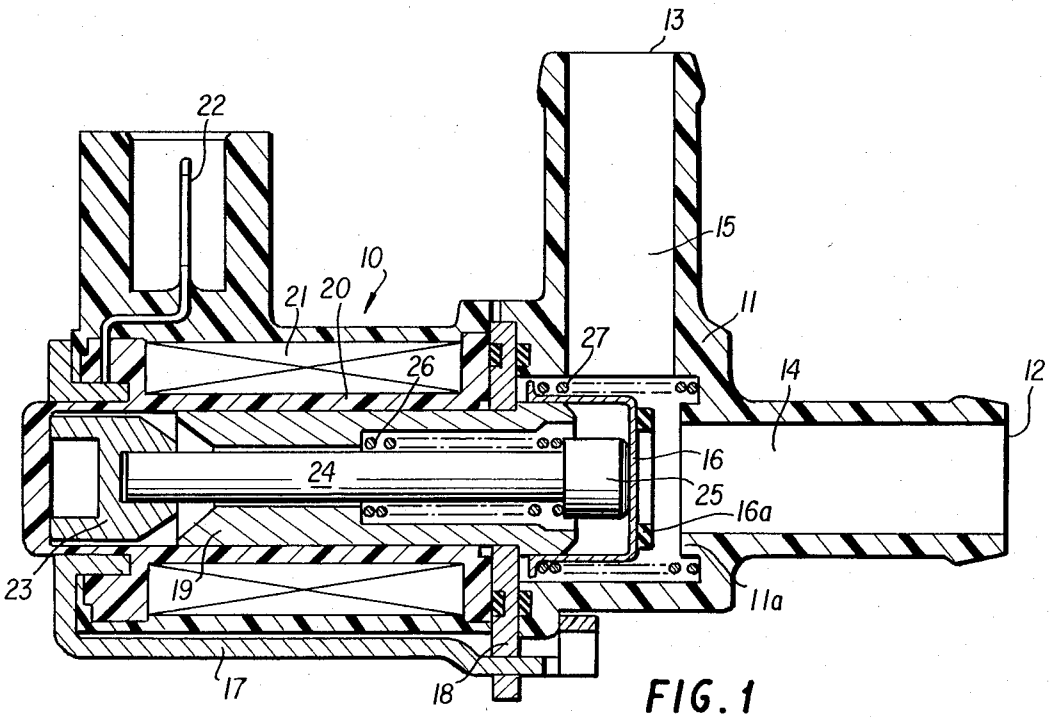
FIG. 1 is a sectional view of a control valve device constructed in accordance with an embodiment of the present invention.
Figure 2:
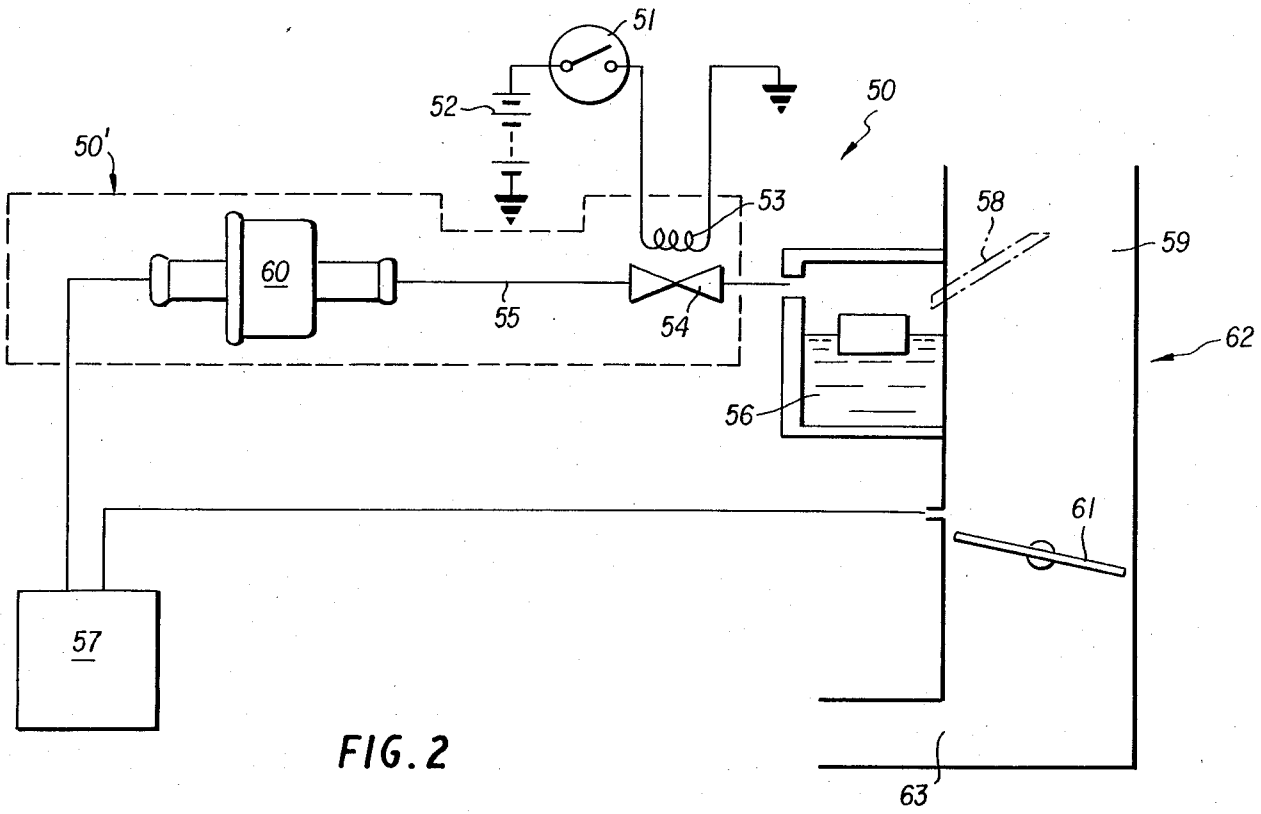
FIG. 2 is a schematic diagram of a conventional carburetor outer vent control system wherein fuel evaporative gases are prevented from being discharged into atmosphere.

Referring now to FIG. 1 showing an embodiment of the invention, a control valve device 10 according to the present invention corresponds to that portion indicated by numeral 50' in FIG. 2.

The device 10 includes a body member 11, made of synthetic resin, which has an inlet port 12 connected with the carburetor float chamber 56 viewed in FIG. 2 and an outlet port 13 connected with the canister 57 viewed in FIG. 2. The body member 11 is provided with fluid passages 14, 15 through which the inlet port 12 and the outlet port 13 communicate with each other.

Communication between the inlet port 12 and the outlet port 13 is controlled by a valve member 16 positioned between the fluid passages 14, 15. Namely, the valve member is provided with a valve portion which is made of rubber material and can be engaged with a valve seat 11*a* formed on the body member 11.

Yoke 17, 18 made of a material of high magnetic permeability is fixedly secured on the leftward opened end of the body member 11. Disposed on the central axis in the yoke 17, 18 is an inner core 19 made of a suitable magnetic material. Disposed on the outer periphery of the inner core 19 is a hollow cylindrical bobbin 20 made of a suitable nonmagnectic material. Wound on the bobbin 20 is a solenoid coil 21 which is electrically connected with a suitable electric source through a terminal 22 to generate a magnetic force. When current is applied to the solenoid coil 21, a magnetic circuit will be formed by the inner core 19 and the yoke 17, 18 by the action of the energization of the solenoid coil 21.

A plunger member 23 made of a suitable magnetic material is positioned in the above-mentioned magnetic circuit. The plunger member 23 is slidably disposed on the same axis with the inner core 19 so that the plunger member may face the leftward end of the inner core 19. A shaft 24 is fixed in the plunger 23 at one end thereof, penetrates the inner core 19 and then protrudes from the rightward end of the inner core 19 at the opposite end thereof. When the above-mentioned plunger 23 is attracted to the inner core 19, a protrusion 25 of the shaft 24 comes in contact with the valve member 16 so that the valve member 16 may be maintained in the closed position.

The shaft 24 is biased rightwardly as viewed in FIG. 2 by a first spring 26 supported on the inner core 19 at one end thereof, whereby the valve member 16 is biased toward the closed position thereof by the protrusion 25 of the shaft 24. At the same time, the valve member 16 is biased toward the opened position thereof, against the biasing force of the first spring 26, by the second spring 27 supported by the body member 11.

The second spring 27 is made of a shape memory alloy and is set so that the load of the first spring 26 may be greater than that of the second spring 27 at low temperature, thereby maintaining the valve member 16 in the closed position. Furthermore, since the second spring 27 is constructed to expand to a memorized shape at a high temperature (over approximately 50° C.), the load of the second spring 27 will become greater than that of the first spring 26, whereby the valve member 16 will be maintained in the open position and be separated from the valve seat 11*a*.

If the ring yoke 18 is made of a heat insulating material, the second spring 27 will be thermally separated from the solenoid coil 21 by means of the yoke 18, thereby preventing the heat generated by the solenoid coil 21 from influencing the second spring 27.

In operation, when the ignition switch 51 shown in FIG. 2 is turned off and no current is applied to the solenoid coil 21, the axial movement of the valve body 16 is determined by the balance of the biasing force between the first spring 26 and the second spring 27. When the temperature of the carburetor float chamber 56 is kept low, the second spring 27 will contract so that the load of the first spring 26 may be greater than that of the second spring 27. Therefore a valve member 16*a* of the valve body 16 will be in engagement with the valve seat 11*a* by a rightward biasing force of the first spring, thereby blocking the communication between the inlet port 12 and outlet port 13 and then blocking the communication between the carburetor float chamber 56 and canister 57.

When the temperature of the carburetor float chamber 56 rises and is kept high (approximately 50° C.), the second spring will be maintained in the expanded shape which is memorized beforehand, whereby the load of the second spring 27 becomes greater than that of the first spring 26. As a result, the valve member 16 will be separated from the valve seat 11*a* by the leftward biasing force of the second spring 27. Therefore, communication between the inlet port 12 and the outlet port 13 will be established, whereby the fuel evaporative gases produced in the carburetor float chamber 56 can be absorbed on the canister 17.

Next, when the ignition switch 51 is turned on and an electric current is applied to the solenoid coil 21, a magnetic circuit will be formed between inner core 19 and the yoke 17, 18 by the action of energization of the solenoid coil 21, whereby the plunger 23 positioned in the magnetic circuit can be attracted by the inner core 19.

Therefore, the shaft 24 fixed in the plunger member 23 will be moved rightwardly so that the protrusion 25 may push the valve member 16. As a result, the valve member 16 can be maintained in the closed position. Thus, during the energization of the solenoid coil 21, the valve member 16 can be maintained in the closed position in spite of the changes in the temperature of the carburetor float chamber 56, thereby blocking the communication between the inlet port 12 and the outlet port 13.

Thus, the shaft 24 is moved with the plunger 23 in response to the operation of the electric magnetic structure and the second spring 27 made of shape memory alloy so as to be expanded at high temperature are operatively connected with each other so that the valve member 16 may be controlled in response to both an input current signal from a switch device and a thermal signal indicating engine ambient temperature. Therefore, the control valve device 10 according to the present invention can be easily mounted on the carburetor float chamber 56 in a carburetor outer vent control system. Furthermore, due to the decrease of required parts of the device 10 can be economically manufactured, be simple in construction and light in weight as compared with conventional devices.

As previously stated, the second spring 27 made of a shape memory alloy is expanded to be of a memorized shape at a high temperature, and the amount of the expansion can be set to be relatively large. Accordingly, the stroke amount of the valve member 16 can be set relatively large in the opening and closing movement thereof, as compared with a device wherein a bimetal disc, whose snap action amount is small, is incorporated as thermal responsive means. As a result, fluid flow resistance can be reduced when the valve member 16 is maintained in the open position, thereby improving the capacity of fluid communication. It is further possible to adapt the device 10 to a control system wherein a large amount of fluid is controlled.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A control valve device for controlling fluid communication in a fluid passage in response to an input current signals from a switch device and changes in ambient temperature, said control device comprising;

a body member having an inlet port and an outlet port, said body having a fluid passage formed therein connecting said inlet port and said outlet port;

a valve member disposed in said fluid passage for controlling fluid communication in said fluid passage;

yoke means made of a magnetic material and fixedly secured on said body member;

an inner core disposed on a central axis in said yoke means;

a bobbin made of a nonmagnetic material and disposed on an outer periphery of said inner core;

a solenoid coil wound on said bobbin and forming a magnetic circuit with said yoke means and said inner core;

a plunger member positioned in said magnetic circuit and disposed on said central axis with said inner core wherein said plunger member is attracted by said inner core upon energization of said solenoid coil;

a shaft fixed in said plunger member at a first end and operatively associated with said valve member at an end opposite said first end;

a first spring supported by said body member at one end and biasing said valve member in a direction of a closed position thereof; and a second spring supported by said body member at one end and biasing said valve member in a direction of an open position thereof wherein said second spring further comprises a shape memory alloy spring expandable so as to maintain a memorized shape at a predetermined temperature.

2. A control valve device as defined in claim 1, wherein said second spring is maintained over approximately 50° C. in an expanded shape memorized beforehand.

3. A control valve device defined in claim 1, further comprising a carburetor outer vent control system of an internal combustion engine to which said device is connected.

4. A control valve device defined in claim 3, further comprising a carburetor float chamber and a canister wherein said inlet port is connected with said carburetor float chamber and said outlet port is connected with said canister.

5. A control valve device as defined in claim 1, wherein said yoke member further comprises a ring yoke made of a heat insulating material and interposed between said solenoid coil and said second spring so as to thermally insulate said second spring from said solenoid coil.

* * * * *